US010156862B2

(12) United States Patent
Krenzke

(10) Patent No.: US 10,156,862 B2
(45) Date of Patent: Dec. 18, 2018

(54) OUTPUT TRANSISTOR TEMPERATURE DEPENDENCY MATCHED LEAKAGE CURRENT COMPENSATION FOR LDO REGULATORS

(71) Applicant: Dialog Semiconductor (UK) Limited, London (GB)

(72) Inventor: Rainer Krenzke, Esslingen (DE)

(73) Assignee: Dialog Semiconductor (UK) Limited, London (GB)

( * ) Notice: Subject to any disclaimer, the term of this patent is extended or adjusted under 35 U.S.C. 154(b) by 20 days.

(21) Appl. No.: 15/372,499

(22) Filed: Dec. 8, 2016

(65) Prior Publication Data

US 2017/0160758 A1 Jun. 8, 2017

(30) Foreign Application Priority Data

Dec. 8, 2015 (DE) ..... 10 2015 224 642

(51) Int. Cl.
*G05F 1/565* (2006.01)
*G05F 1/575* (2006.01)

(52) U.S. Cl.
CPC ..... *G05F 1/575* (2013.01)

(58) Field of Classification Search
CPC ..... G05F 1/565; G05F 1/575
USPC ..... 323/280–286, 315
See application file for complete search history.

(56) References Cited

U.S. PATENT DOCUMENTS 4,808,908 A * 2/1989 Lewis ..... G05F 3/30 323/313
5,039,878 A * 8/1991 Armstrong ..... G01K 3/005 323/907
5,391,980 A * 2/1995 Thiel ..... G05F 3/30 323/314
5,559,425 A * 9/1996 Allman ..... G05F 3/262 323/313
6,118,263 A * 9/2000 O'Neill ..... G05F 3/222 323/315
6,157,245 A * 12/2000 Rincon-Mora ..... G05F 3/267 327/513
6,175,224 B1 * 1/2001 Kadanka ..... G05F 3/30 323/280
6,198,266 B1 * 3/2001 Mercer ..... G05F 1/575 323/275
6,323,628 B1 * 11/2001 Park ..... G05F 3/30 323/281
6,366,071 B1 * 4/2002 Yu ..... G05F 3/30 323/316
7,030,598 B1 * 4/2006 Dow ..... G05F 1/575 323/313

(Continued)

*Primary Examiner* — Adolf Berhane
*Assistant Examiner* — Nusrat Quddus
(74) *Attorney, Agent, or Firm* — Saile Ackerman LLC; Stephen B. Ackerman

(57) ABSTRACT

Circuits and methods to compensate leakage current of a LDO regulator are disclosed. The compensation is achieved by a temperature dependent sink current generation, matched with its temperature dependency characteristic to the LDO regulator output transistor leakage, which has a nearly zero current consumption increase of about 50 nA at room temperature and starts sink current at temperatures about above 85 to 125 degrees Celsius, which is corresponding to a range of temperature wherein leakage currents come into account.

24 Claims, 8 Drawing Sheets

(56) References Cited

U.S. PATENT DOCUMENTS

| | | | | |
|---|---|---|---|---|
| 7,084,698 | B2 * | 8/2006 | Khan | G05F 3/30 323/313 |
| 7,126,316 | B1 * | 10/2006 | Dow | G05F 3/222 323/280 |
| 7,227,401 | B2 * | 6/2007 | Zhang | G05F 3/245 327/513 |
| 7,276,890 | B1 * | 10/2007 | Kumar | G05F 3/30 323/313 |
| 7,362,081 | B1 * | 4/2008 | Huang | G05F 1/575 323/282 |
| 7,595,627 | B1 * | 9/2009 | Mahnke | G05F 3/16 323/315 |
| 2013/0265020 | A1 * | 10/2013 | Krenzke | G05F 1/56 323/273 |

* cited by examiner

OUTPUT TRANSISTOR TEMPERATURE DEPENDENCY MATCHED LEAKAGE CURRENT COMPENSATION FOR LDO REGULATORS

TECHNICAL FIELD

This disclosure relates generally to DC-to-DC converters and relates more specifically to linear regulators as e.g. low-dropout (LDO) regulators having output transistor temperature dependent leakage current compensation.

BACKGROUND

A low-dropout or LDO regulator is a DC linear voltage regulator, which can operate with a very small input-output differential voltage. The advantages of a low dropout voltage regulator include a lower minimum operating voltage, higher efficiency operation and lower heat dissipation. The main components of a LDO regulator are an output power transistor (e.g. FET or bipolar transistor) and a differential amplifier (error amplifier). One input of the differential amplifier monitors the fraction of the output determined by a feedback voltage divider having a given divider ratio. The second input to the differential amplifier is from a stable voltage reference (e.g. bandgap reference). If the output voltage rises too high relative to the reference voltage, the drive to the output power transistor changes to maintain a constant output voltage.

Usual LDO applications require source capability by using one output transistor (output device) only, and usual LDO implementations therefore have a sourcing output transistor stage only. Any topology with sink-and-source capability will require a second output transistor and hence more silicon area and corresponding control circuitry which will increase also the quiescent current consumption. The sink capability of a LDO regulator with source transistor output stage is limited by its internal circuit current consumption. Especially for very low-power LDO regulators or for the low-power mode of LDO regulators, the current consumption of the internal circuitry is in the range of a few μA (Milliampere) or even far below 1 μA. Therefore there is nearly no sink capability available for low-power LDO regulators with only source transistor output stage.

If the LDO regulator is operated at higher temperature, e.g. above 85 degrees Celsius or even up to 125 degrees Celsius, the leakage current of a big output transistor starts to get relevant and could exceed the sink capability. The result would be an increase of LDO output voltage, which could in the worst case jump up to the LDO input voltage so that the regulation capability of the LDO regulator would be completely lost.

In order to overcome this problem, a voltage monitor and clamping circuitry could be used. The drawback of this solution is additional current consumption by such circuitry, which may not be acceptable for ultra-low-power designs. Another solution could be a LDO regulator with source-sink output stage as mentioned above. Again, such output stage requires more complex control and requires maintaining the loop stability for the whole circuitry, and furthermore will cause additional current consumption.

Another solution could be to add a constant-current sink with a fixed value of the maximum expected leakage current of the source output transistor. However, this approach would again increase the current consumption, even at room temperature.

It is a challenge for engineers designing LDO regulators to efficiently compensate leakage current, i.e. without additional power consumption and without complex control.

Known attempts of addressing this issue fail to match the output device leakage current over the full relevant temperature range. Specifically, the matched leakage current and the actual leakage current will differ significantly from each other either at higher temperature, or, if designed to match at higher temperature, the matched leakage current will require too high a value at the lower temperature range, thereby increasing the quiescent current of the LDO circuitry.

SUMMARY

There is a need for a very low-power LDO regulator with capability of stable operation at no output current load and for high temperature up to leakage current relevant ranges (e.g. usually above 85 degrees Celsius, with critical effects in the range of about 125 to 150 degrees Celsius). There is a further need to minimize power consumption for output voltage protection of LDO regulators due to leakage current caused output voltage increase. There is a further need to prevent any output voltage increase of LDO regulators due to leakage current without requiring any overvoltage monitoring and clamping circuitry. There is a further need to prevent any output voltage increase of LDO regulators due to leakage current without requiring a complex sink-source output stage. There is a further need to prevent any output voltage increase of LDO regulators due to leakage current relying only on a single source transistor. There is a further need to prevent any output voltage increase of LDO regulators due to leakage current without impacting topology of the LDO regulation loop and the loop compensation scheme and without having to apply another regulation loop for the leakage current compensation circuitry. There is a yet further need to match the leakage current compensation over the complete temperature range and hence to have optimized compensation at the high end of the relevant temperature range as well as at the lower temperature range where leakage currents start to occur, thereby not wasting current consumption on the whole circuitry. There is generally a need for a LDO regulator (e.g. low power LDO regulator) with improved leakage current compensation at reduced overall current consumption. In view of at least some of these needs, the present document proposes a method of leakage current compensation for a LDO regulator and a circuit for leakage current compensation of a LDO regulator, having the features of the respective independent claims.

An aspect of the disclosure relates to a method of leakage current compensation for a LDO regulator (e.g. a low power LDO regulator or an ultra-low power LDO regulator). The method may be a method that does not impact the topology of the LDO regulation loop and/or the loop compensation scheme. The method may comprise a step of (1) providing a LDO regulator and a sink current generator. The sink current generator may be a high-order sink current generator. Moreover, the sink current generator may be a non-proportional-to-temperature (non-PTAT) type sink current generator. The sink current generator may be configured so as to match the sink current temperature characteristic to the temperature characteristic of a leakage current of an output device (e.g. output transistor, pass transistor) of the LDO regulator. The method may further comprise a step of (2) deploying the sink current generator on a same semiconductor substrate (e.g. silicon) as the LDO regulator. The sink current generator and the LDO regulator may be deployed such that they are thermally coupled. In particular, the sink current generator and the LDO regulator may be thermally coupled to each other in such a manner that substantially isothermal operation is achieved. For instance, the sink current generator and the LDO regulator may be deployed on a same chip. The method may further comprise a step of (3) providing a sink current by the sink current generator as required to compensate a leakage current of the LDO output device, wherein the sink current and the leakage current may depend upon a common junction temperature of both the LDO regulator and the sink current generator. The high-order characteristic of the non-PTAT type sink current generator may be chosen so as to match the mostly exponential temperature dependency characteristic of the output device of the LDO regulator. Therein, high-order can mean e.g. second order, third order or exponential order, as long as a non-PTAT characteristic is realized.

Configured as above, the proposed method enables implementation of a low quiescent current LDO regulator with high output drive capability for wide (i.e. high) temperature range. Using the proposed method, the LDO regulator does not require fixed sink capability (even at room temperature) to compensate for an output transistor leakage current and hence features optimized no-load current consumption at a temperature range that is not affected by leakage current effects. Employing a non-PTAT type sink current generator, the temperature characteristic of the sink current can be closely matched to the temperature characteristics of the output transistor leakage current, allowing to optimize the LDO circuitry for low quiescent current consumption even at no-load condition over the full temperature range, specifically for LDO regulators with high output load drive capability (i.e. with big output transistors). Moreover, the proposed method allows for simple scaling of the sink current, thus enabling to adapt to a wide range of leakage currents and correspondingly to a wide range of sizes of the output transistor of the LDO regulator.

In embodiments, the method may further comprise a step of sensing an output current of the LDO regulator, e.g. by means of a mirror sense device (e.g. mirror sense transistor) arranged in parallel to the output device (e.g. output transistor) of the LDO regulator. The mirror sense device may be a scaled replica of the output device of the LDO regulator. The method may further comprise detecting an output current load condition. The method may further comprise a step of reducing (e.g. gradually, or non-gradually) the sink current provided by the sink current generator on condition that the sensed output current exceeds a predetermined threshold value for the output current. The reduced sink current may not be sufficient for compensation of the leakage current of the LDO output transistor for the actual common junction temperature of the LDO regulator and the sink current generator. Said reduction of sink current may be performed only for values of the sensed output current in excess of the predetermined threshold value. In other words, leakage current compensation may only be provided for small or zero output current (small or zero output load) below the predetermined threshold value. This may be achieved by appropriate control of the sink current generator. Reducing the sink current may include reducing the sink current to zero, i.e. disabling the sink current generator. Thereby, current consumption of the LDO regulator can be further reduced.

Another aspect of the disclosure relates to a circuit of a non-PTAT type sink current generator used for leakage current compensation for a LDO regulator (e.g. a low power LDO regulator or an ultra-low power LDO regulator). The sink current generator may be a high-order sink current generator. Moreover, the sink current generator may be a non-PTAT type sink current generator. The sink current generator may be configured so as to match the sink current temperature characteristic to the temperature characteristic of a leakage current of an output device (e.g. output transistor, pass transistor) of the LDO regulator. The LDO regulator and the sink current generator may be deployed on a same semiconductor substrate (e.g. silicon). The sink current generator and the LDO regulator may be deployed such that they are thermally coupled. In particular, the sink current generator and the LDO regulator may be thermally coupled to each other in such a manner that substantially isothermal operation is achieved. For instance, the sink current generator and the LDO regulator may be deployed on a same chip.

The circuit according to this aspect may comprise a port for a bias current. Said port may be connected to a first terminal of a switch which can activate/deactivate the sink current generator. The circuit may further comprise said switch. Said switch may be controlled by a switch control signal (e.g. a control voltage). The switch control signal may depend on a common junction temperature of the circuits of the LDO regulator and the sink current generator and thereby operate in dependency on chip junction temperature. Alternatively, the switch control signal may just be used as external control access point to statically enable/disable the leakage compensation circuitry, i.e. together with enable/disable of the LDO regulator itself. In case of switch control on dependence on the common junction temperature, said switch control signal may switch OFF all transistors that might cause power consumption while the junction temperature is below a temperature threshold value, and switch on all transistors if the junction temperature is above the temperature threshold value. The temperature threshold value may be a fixedly defined value or a variably set value and may thereby allow user adoption or adoption to process variation and/or application requirement.

The circuit according to this aspect may further comprise a port for an output of the sink current generator. Said port may be connected to an output port of the LDO regulator. The circuit may further comprise an arrangement of transistors forming a non-PTAT circuit, e.g. a high-order non-PTAT circuit. The non-PTAT circuit may generate a non-PTAT current. The non-PTAT current and the leakage current may depend upon the junction temperature. The circuit may yet further comprise an arrangement of current mirrors to scale down the non-PTAT current in order to obtain a sink current suitable to compensate a leakage current of the correspondingly used output device of the LDO regulator.

In embodiments, the circuit may further comprise an output current sense part (output load sense part) for additional control of the sink current generator. The output current sense part may sense the output current of the LDO regulator, i.e. the current flowing through the output device of the LDO regulator. The output current may be sensed by means of a mirror sense device (e.g. a mirror sense transistor) that is arranged in parallel to the output device of the LDO regulator. The mirror sense device may be a scaled replica of the output device of the LDO regulator. The mirror sense device and the output device may form a current mirror. The circuit may further comprise a sink current generator disabling part for reducing the sink current generated by the sink current generator and/or altogether disabling the sink current generator. If the sensed output current is found to exceed a predetermined threshold value for the output current, the sink current generator disabling part may reduce the sink current. The reduced sink current may not be sufficient for compensation of the leakage current of the LDO output transistor for the actual common junction temperature of the LDO regulator and the sink current generator. For example, the sink current may be controlled in accordance with a function (e.g. a linear function) of the output current that decreases for increasing output current above said predetermined threshold value. Alternatively, the sink current generator disabling part may altogether disable the sink current generator if the sensed output current is above the predetermined threshold value for the output current. Yet further alternatively, the sink current may be controlled in accordance with a function (e.g. a linear function) of the output current that decreases for increasing output current, and may be altogether disabled once the sensed output current is above the predetermined threshold value for the output current. In other words, the sink current generator disabling part may provide either an ON/OFF control scheme for the sink current generator, a regulation scheme for controlling the sink current for output currents above said predetermined threshold value, or a regulation scheme combined with an ON/OFF control scheme. Therein, the sink current generator is disabled or the sink current is reduced if the sensed output current exceeds the predetermined threshold value. Accordingly, leakage current compensation will be applied only in case of zero or small external output load current that would not by itself compensate the leakage current.

In the above aspects, different types of non-PTAT type sink current generators can be used, depending on the nature of leakage current behavior. For MOS or bipolar transistors that are mostly used as output devices for LDO regulators, a drain or collector leakage current has exponential behavior resulting from the physics of p-n junctions. For instance, for silicon the drain/collector leakage current doubles every 6 degree Celsius, or every 10 degrees for germanium. The same characteristics should be implemented by the compensation current sink circuitry. Accordingly, the sink current generator should be of higher-order, i.e. at least of second order, but not of PTAT type.

It will be appreciated that method steps and apparatus features may be interchanged in many ways. In particular, the details of the disclosed method can be implemented as an apparatus adapted to execute some or all or the steps of the method, and vice versa, as the skilled person will appreciate. Moreover, it is understood that methods according to the disclosure relate to methods of operating the current sensing circuits according to the above embodiments and variations thereof.

BRIEF DESCRIPTION OF THE DRAWINGS

Embodiments of the disclosure are explained below in an exemplary manner with reference to the accompanying drawings, wherein.

DESCRIPTION

Methods and circuits for LDO regulators, such as very low power LDO regulators, for example, with capability of stable operation at no output current load and for high temperatures up to leakage current relevant ranges (e.g. usually above 85 degrees Celsius, with critical effects in the range of about 125 to 150 degrees Celsius) are disclosed. The complete current consumption of the LDO regulator according to the present disclosure may be in the range of 1 μA to 2 μA at room temperature or even below 1 μA.

The disclosure can be applied to all LDO regulators with just source output, i.e. unipolar output current load capability. In case of a source/sink output stage the problem of leakage currents would be already inherently solved. Considering single output device type LDO regulators, the disclosure will be applicable to either FET, MOSFET or bipolar output transistor implementations and hence relates to PMOS/NMOS or PNP/NPN output transistor types.

Figure 1A:
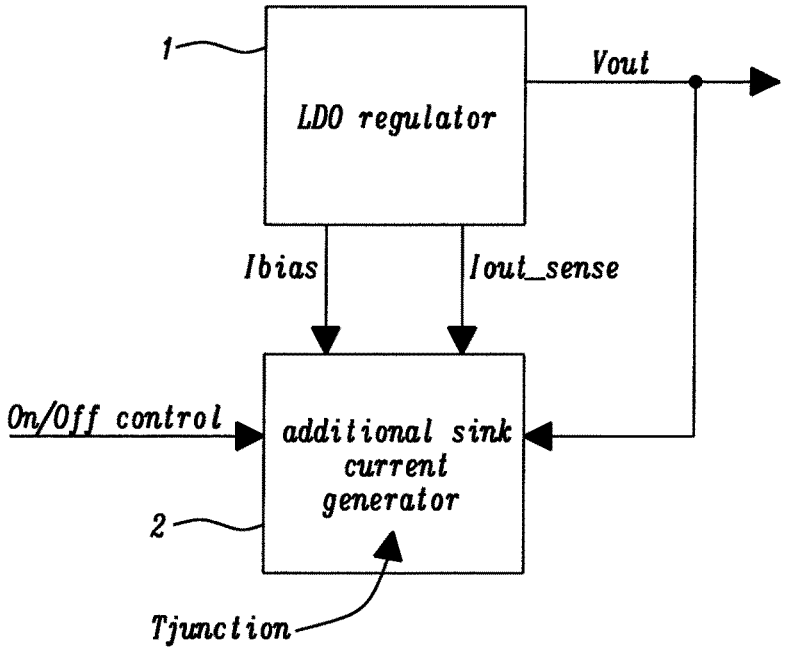
FIG. 1*a* shows a basic block diagram of the main components of an example of a circuit according to embodiments of the disclosure.

FIG. 1*a* shows a basic block diagram of the main components of an example of a circuit according to embodiments of the disclosure. In particular, FIG. 1*a* shows a configuration in which a bias current Ibias and a sensed output current Iout_sense are provided from a LDO regulator 1 (LDO regulator circuit, LDO regulator circuit block) to a sink current generator 2 (sink current generator circuit, sink current generator circuit block) as input information. Tjunction denotes the maximum junction temperature of a transistor. The LDO regulator 1 may be a conventional LDO regulator. The sink current generator 2 may be a high-order, non-PTAT type sink current generator. The LDO regulator 1 outputs an output voltage Vout. An indication of the output voltage Vout is also provided to the sink current generator 2, i.e. the sink current generator 2 is connected to the output node of the LDO regulator 1. The sink current generator 2 maintains a sink current generation dependent on junction temperature and has zero or nearly zero current consumption on room temperature and a relevant sink current at high junction temperatures, e.g. in the range between 125 degrees Celsius and 150 degrees Celsius. The sink current is easily scalable to adopt for different output transistor sizes, i.e.

different leakage current values, which are also dependent upon transistor sizes. The temperature dependency characteristic of the sink current generator 2 may be 2nd-order, 3rd-order, or exponential order, for example, but is typically not a temperature proportional (PTAT) characteristic. Put differently, the sink current generator 2 has non-PTAT characteristic.

Figure 1B:
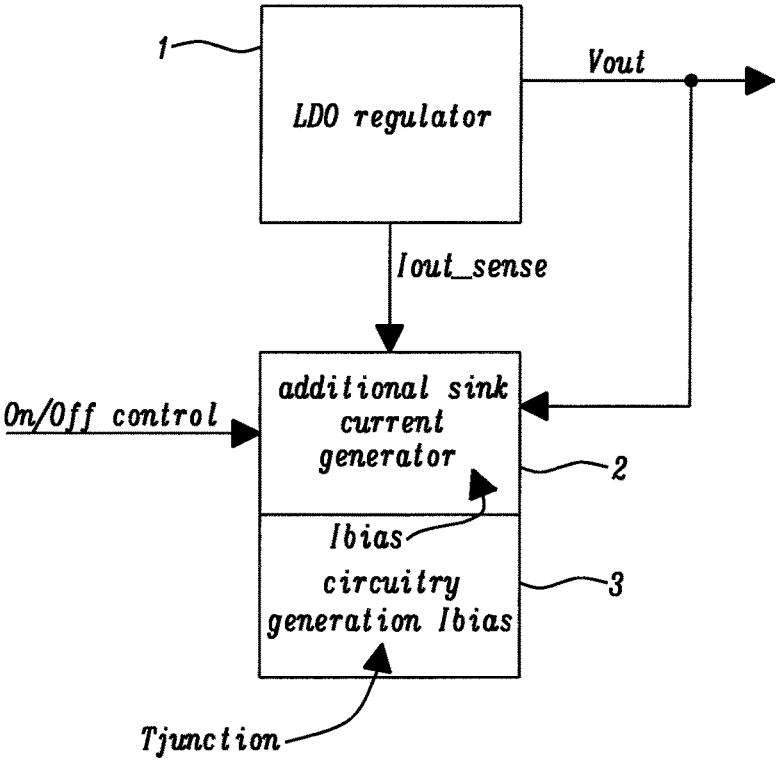
FIG. 1*b* shows a basic block diagram of the main components of another example of the circuit according to embodiments of the disclosure.

The sink current generator 2 needs dedicated current biasing to maintain a defined sink current level. The biasing current could be derived either by a usual LDO current biasing or by an own bias current generation, or derived from another ($3^{rd}$) circuit block, if better accessible or derivable therefrom. This alternative configuration is shown in FIG. 1*b* in which the bias current is generated and provided by a third circuit block 3 to the sink current generator 2. The third circuit block 3 may be connected to the sink current generator 2.

The sink current generator 2 provides a junction temperature (Tjunction) dependent sink current generator and is a high-order, e.g. 2nd-order, 3th-order or exponential order and hence non-PTAT type circuit. The better the order of the sink current generator 2 matches the temperature characteristic of the LDO output transistor leakage current, the more efficient the leakage compensation will work with respect to overall low quiescent current consumption. Due to possibly increased circuit complexity for higher-order characteristic implementation, it might be a good compromise to implement a $2^{nd}$-order sink current generator 2. However, the present disclosure shall not be construed as limited to a $2^{nd}$ order sink current generator 2.

The output transistor of the sink current generator 2 may be either a NMOS transistor or a bipolar transistor, for example. The output transistor may be used to mirror-out the sink current with any factor m. Thereby, the sink current value can be easily scaled to the current value required by the applicable size of the output transistor of the LDO regulator 1.

A well-defined bias current, which is usually available on the LDO regulator and sufficiently mirrored down to a few tens of nA (Nanoampere), e.g. 50 nA, could be used to provide a very low current at room temperature.

FIG. 1*b* shows a case in which ON/OFF control of the sink current generator 2 is derived from the junction temperature (Tjunction). The circuit shown comprises a temperature sensor 41, e.g. arranged on-chip, as well as a temperature comparator 42. The temperature sensor 41 outputs a temperature equivalent voltage value which is fed to an input port of the temperature comparator 42. At the temperature comparator 42, said temperature equivalent voltage value is compared to a temperature equivalent threshold voltage value, and a control signal (e.g. switch control signal) for ON/OFF control of the sink current generator 2 is generated and output in dependence on a result of the comparison. The temperature comparator 42 may be a comparator with hysteresis.

Figure 1C:
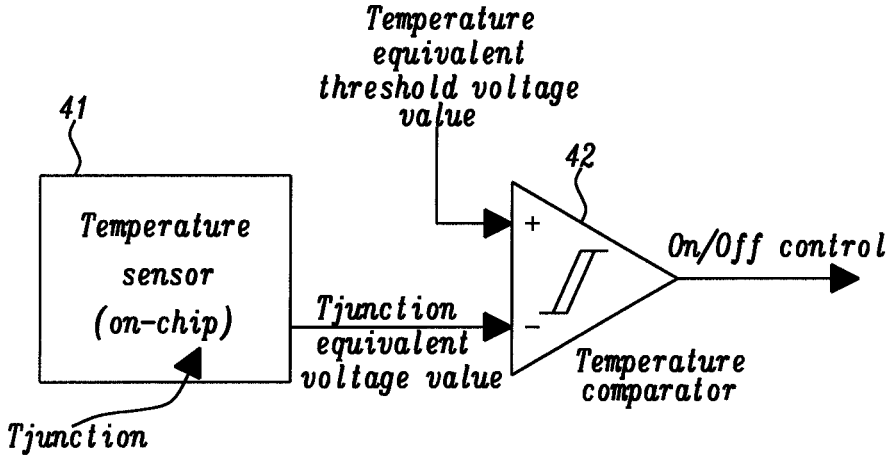
FIG. 1*c* shows a basic block diagram of an example of ON/OFF control signal generation for the circuit according to embodiments of the disclosure.

In case the ON/OFF control of the sink current generator 2 is derived from an existing temperature comparator on the chip, as shown in FIG. 1*c*, the sink current generator 2 could be switched OFF at temperatures below a defined high-temperature threshold, thus achieving zero current consumption at room temperature. Only for the high temperature range, e g. a range between 125 degrees and 150 degrees Celsius, or somewhere above 85 degree Celsius, at least in a temperature range where leakage current starts to relevantly occur, the sink current generator circuit 2 is switched ON. The reason is that only in this junction temperature range the operation of the sink current generator circuit 2 is required since leakage currents are starting in this junction temperature range, especially with a large output transistor device which is implemented on the same silicon and chip. In this case the output transistor of the LDO regulator 1 has the same junction temperature as the sink current generator circuit 2.

In embodiments, ON/OFF control of the sink current generator 2 may additionally be performed in dependence on the output current (Iout_sense) of the LDO regulator 1. To this end, either a second control signal (e.g. second switch control signal) for ON/OFF control may be generated, or the control signal for ON/OFF control generated by the temperature comparator 42 in FIG. 1*c* may be modified. For example, a resulting control signal for ON/OFF control may correspond to an OR-combination of the aforementioned control signal and second control signal for ON/OFF control. To generate the second control signal, the output current of the LDO regulator 1 (i.e. the current flowing through the output transistor of the LDO regulator 1) may be sensed, e.g. by means of a mirror sense transistor arranged in parallel to the output transistor as shown in FIG. 2*e*. The second control signal may be configured to switch OFF (disable) the sink current generator 2 for a sensed output current above a given threshold value for the output current, and to leave the sink current generator in the ON state for the sensed output current below the given threshold value for the output current. For example, leakage current compensation by sink current generation may only be performed for no output load or small output load, thereby reducing overall current consumption of the circuitry. Alternatively, the sink current generated by the sink current generator 2 may be (gradually) reduced for sensed output currents above the given threshold for the output current. Yet further alternatively, the sink current generated by the sink current generator 2 may be gradually reduced in dependence on the sensed output current, and may be altogether disabled once the sensed output current is above the given threshold for the output current. Sensing the output current may be said to correspond to detecting an output current load condition.

Figure 2A:
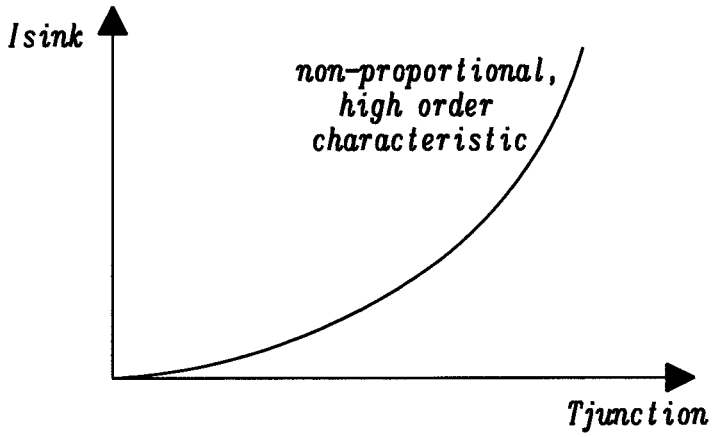
FIG. 2*a* shows an exemplary waveform diagram with temperature dependency characteristic of high-order sink current generation.

FIG. 2*a* shows an example of a waveform diagram with temperature dependency characteristic of high-order sink current generation according to embodiments of the disclosure. This characteristic may be e.g. of $2^{nd}$, $3^{rd}$ or exponential order, for example.

Importantly, the characteristic is not non-proportional-to-temperature (non-PTAT), as indicated above.

Figure 2B:
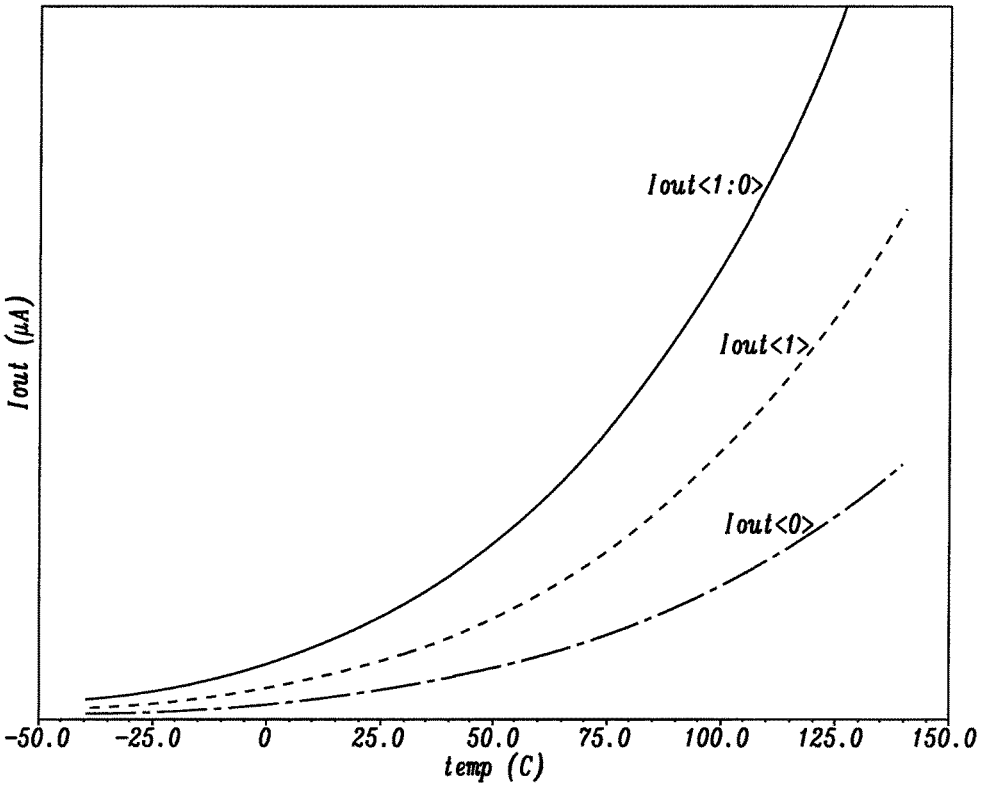
FIG. 2*b* shows an exemplary waveform diagram with temperature dependency characteristic of high-order sink current generation of a sink current generator according to embodiments of the disclosure.
Figure 2C:
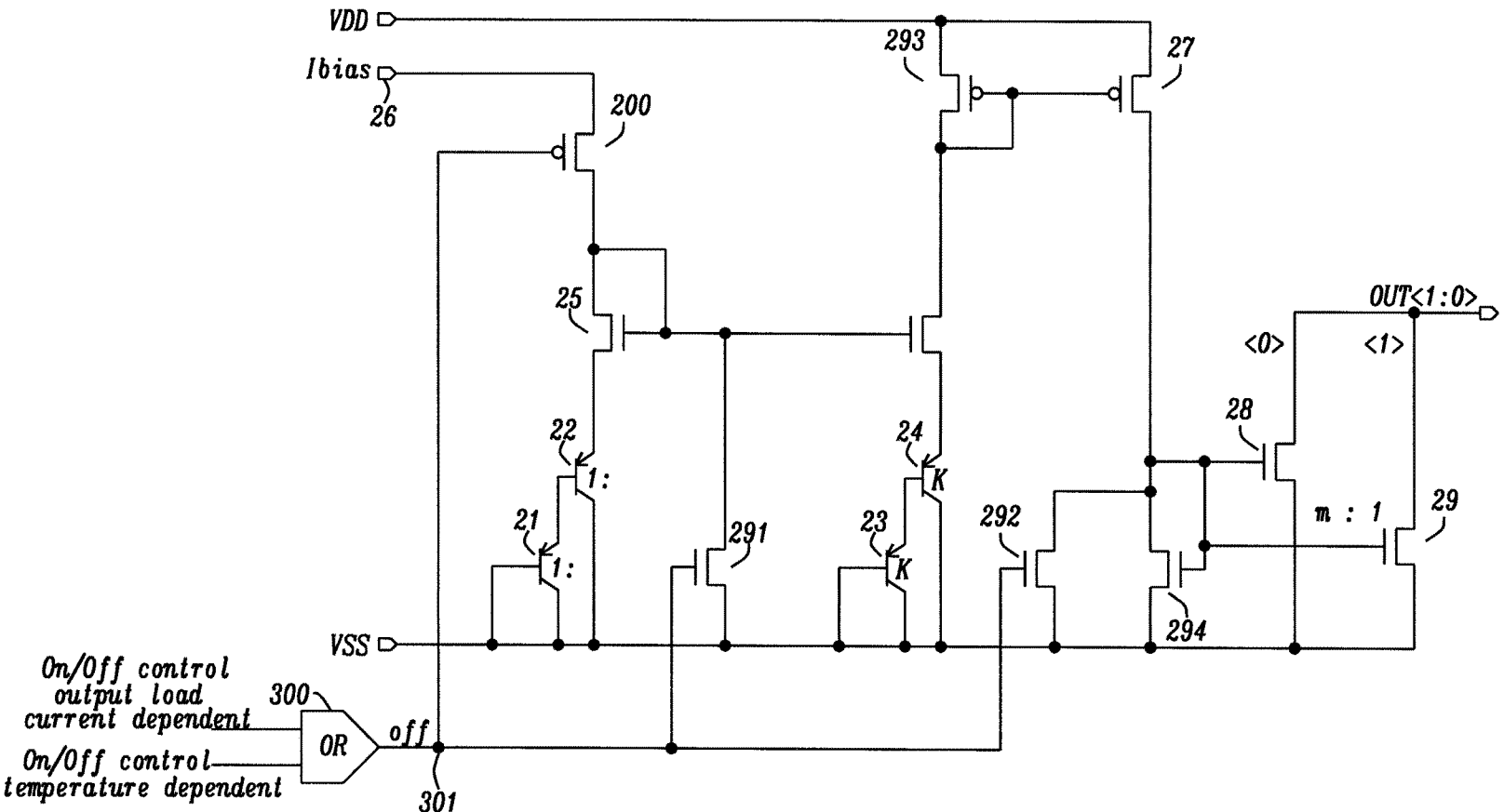
FIG. 2*c* shows a circuit diagram of an example of a non-PTAT, higher-order sink current generator according to embodiments of the disclosure with ON/OFF control dependent on temperature and output load current.

FIG. 2*b* shows an example of a waveform diagram with temperature dependency characteristic of approximately $2^{nd}$-order sink current generation by the sink current generator 2 which corresponds to the circuit diagram of FIG. 2*c*.

FIG. 2*c* shows an example of a sink current generator 2 according to embodiments of the disclosure. In a preferred embodiment, bipolar transistors 21-24 together with NMOS transistor 25 form a non-PTAT circuit, i.e. a circuit generating a current dependent upon the junction temperature of the semiconductor substrate (e.g. silicon) on which the circuit is deployed. The bipolar transistors 21-24 can be single transistors or stacked together. The stacked bipolar transistor configuration improves the non-PTAT behavior with respect to a required ratio of bipolar transistors 21 and 22 to 23 and 24, wherein bipolar transistor 21 has a ratio to transistor 23 of 1:K, and bipolar transistor 22 has the same ratio of 1:K ratio to transistor 24, wherein K is a number of higher than 1.

There usually needs to be implemented a ratio of 1:K between the bipolar transistors of input branch 21 (and 22 if used) and mirrored branch transistor 23 (and 24 if used).

This factor is often chosen in the range of a value of 2 to 4. To better maintain the sink current generation without too big transistor dimensions, there could be also used transistor 25 as an isolated NMOS transistor in a deep n-well/p-well. It should be noted that alternatively other arrangements of transistors forming such a circuit could be used as well. Defined current biasing of e.g. 50 nA is provided via port 26. The port 301 denoted off provides a voltage to switch OFF the sink current generator 2 in a way that zero power is consumed, e.g. the bias current may be blocked via the gate of transistor 200. The voltage of the port 301 may be activated while the junction temperature is below a threshold, for which case no leakage current compensation would be is required. Furthermore the gates of transistors 291 and 292 are connected to the voltage of port 301 and both transistors switch OFF if the voltage of port 301 is activated.

The sink current is mirrored out by transistor 27, which is a part of a current mirror formed by transistors 293 and 27, and following transistors. Transistors 28 and 29 build a quasi-binary scaling of sink current. Unused outputs can be shorted to the VSS voltage level so that they do not contribute to the sink current value. Binary scaling of the sink current can be achieved by the current mirror ratios of the transistors 28 and 29. If transistor 28 has a ratio of e.g. 1 and transistor 29 a ratio of m=2 in relation to the left side branch NMOS transistor 294, it would generate an output sink current of 1·I(27)+2·I(27) wherein I(27) is the current flowing through transistor 27. This is a binary scaling as it represents the first two coefficients of the power-of-two series ($0^2$=1, $1^2$=1). If the two outputs OUT<1:0> are used in different configurations of the LDO output drive transistor and hence different leakage currents, it could be used as sink capability of either 1·I(27) means OUT<0>, or 2·I(27) means OUT<1>, or 2·I(27)+1·I(27) means both OUT<1:0> together.

The above may be said to correspond to a binary scheme. However, the present disclosure is not to be construed as limited to a binary schemes, and other coding schemes are also feasible, such as thermometer coding, for example. Each unused output of OUT< > will be shorted to the VSS voltage level or could be even left floating. While floating nodes are often not considered good style of circuit design, there would not be any disadvantages from a functional point of view in the present situation. FIG. 2*b* shows the sink current Iout waveforms for the described binary configurations described above, namely, OUT<0>, OUT<1>, OUT<1:0>, as Iout<0>, Iout<1>, and Iout<1:0>, respectively.

FIG. 2*c* further illustrates ON/OFF control in dependence on junction temperature and/or sensed output current. A first control signal (e.g. first switch control signal) for ON/OFF control derived in dependence on junction temperature and a second control signal (e.g. second switch control signal) for ON/OFF control derived in dependence on the sensed output current (output load) of the LDO regulator 1 may be provided to logic element 300, which implements an OR-circuit. If either or both of the first or second control signals indicate that the sink current generator 2 is to be disabled (turned OFF), a corresponding signal is applied to port 301 of the sink current generator 2.

Figure 2D:
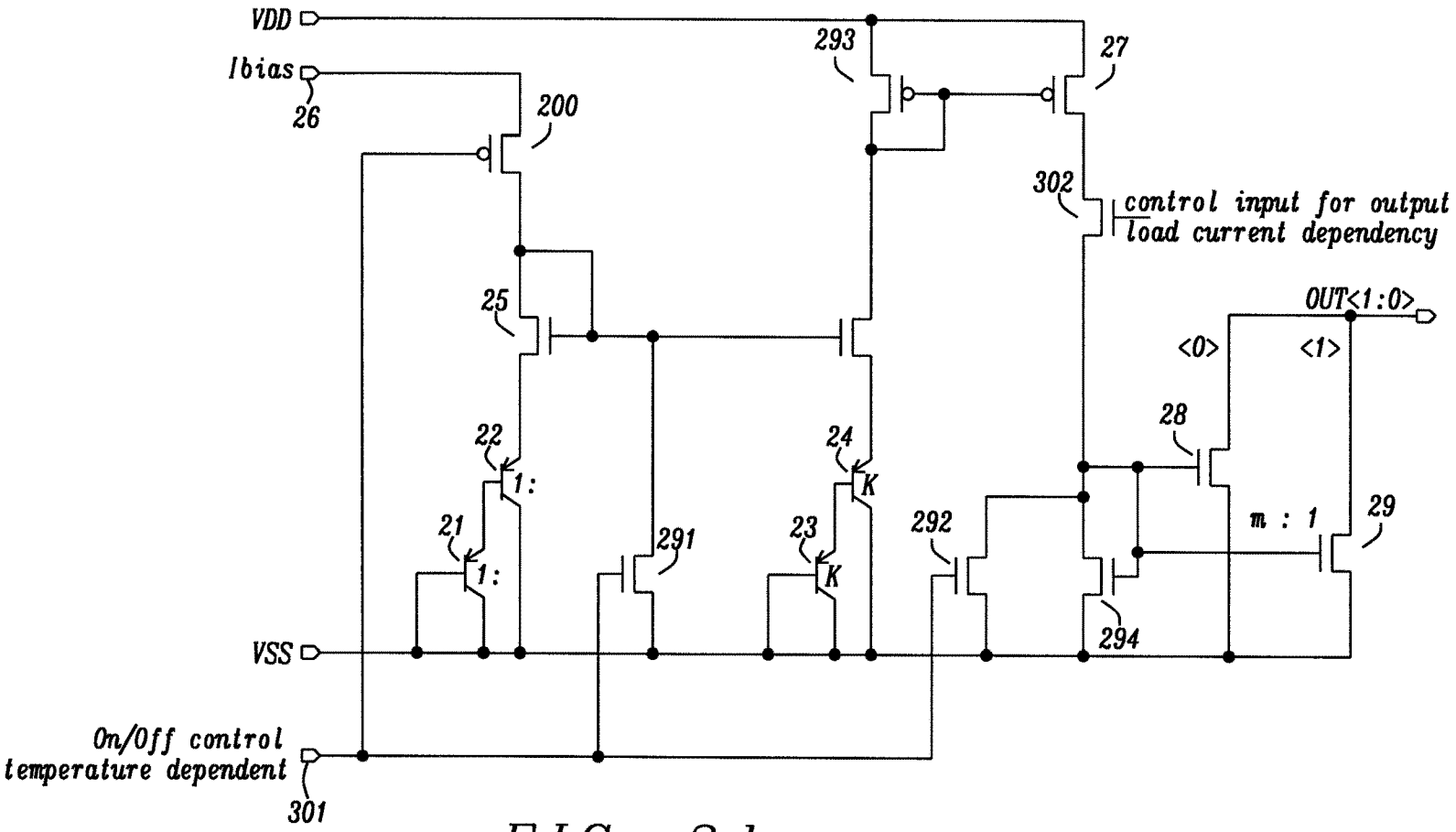
FIG. 2*d* shows a circuit diagram of another example of the non-PTAT, higher-order sink current generator according to embodiments of the disclosure with ON/OFF control dependent on temperature and output load current.
Figure 2E:
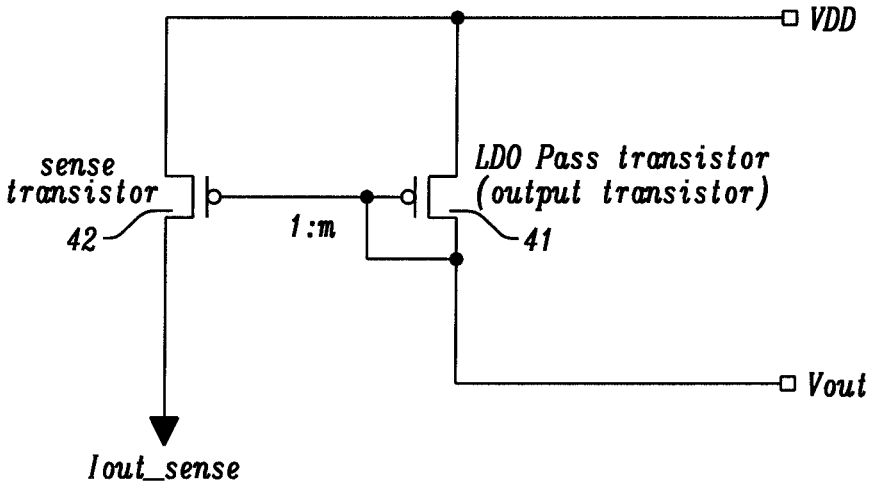
FIG. 2*e* shows an example of a circuit for output current sensing that may be used in circuits according to embodiments of the disclosure.

FIG. 2*d* illustrates a variation of the sink current generator 2 in FIG. 2*c*. Here, the signal input to port 301 is the control signal for ON/OFF control that is derived in dependence on the junction temperature. Control of the sink current generator 2 in dependence on the output current of the LDO regulator 1 is performed via additional transistor 302 that is connected in series between transistors 27 and 294. A voltage at the gate terminal of transistor 302 may depend on the sensed output current (output load) of the LDO regulator 1. Said gate voltage may correspond to the second control signal for ON/OFF control described above with reference to FIG. 1*c*. Moreover, said gate voltage may take values such that the sink current generator 2 is disabled (i.e. the transistor 302 is switched to the non-conducting state) for a sensed output current of the LDO regulator above the given threshold value for the output current (output load), but is not disabled for the sensed output current below the given threshold value. Alternatively, the gate voltage may be controlled to take values such that the sink current generated by the sink current generator 2 is decreased for sensed output currents above the given threshold value, e.g. in accordance with a function that is negatively correlated with the output current (i.e. decreases for increasing output current), e.g. a linear function with negative gradient. Further alternatively, the gate voltage may be controlled to take values such that the sink current generated by the sink current generator is gradually decreased in dependence on the sensed output current (e.g., in accordance with a function that is negatively correlated with the output current), and such that the sink current generator 2 is disabled (i.e. the transistor 302 is switched to the non-conducting state) for a sensed output current of the LDO regulator above the given threshold value for the output current. The reduced sink current may not be sufficient for compensation of the leakage current of the LDO output transistor for the actual common junction temperature of the LDO regulator and the sink current generator. Notably, the sink current is not reduced in this manner for sensed output currents below the given threshold value, i.e. in this case the sink current is adapted to compensate the leakage current of the LDO output transistor.

FIG. 2*e* illustrates an example of a circuit configuration for sensing the output current of the LDO regulator 1. A sense transistor 42 is arranged in parallel to the output transistor 41 (output pass transistor, in general, output device) of the LDO regulator 1. Gate terminals of transistors 41 and 42 may be connected to each other and further to the drain terminal of the output transistor 41. The output transistor 41 and the sense transistor 42 may be said to form a current mirror. The sense transistor 42 may be a scaled replica of the output transistor 41. The scaling ratio may be 1:m, with m greater than or equal to 1. Then, the current Iout_sense flowing through the sense transistor 42 may be a scaled version of the output current of the LDO regulator 1 and may serve as an indication thereof. Thus, the current Iout_sense may be used for deriving therefrom the aforementioned second control signal for ON/OFF control of the sink current generator 2. In general, the output current may be said to be sensed by an output current sense part.

Figure 2F:
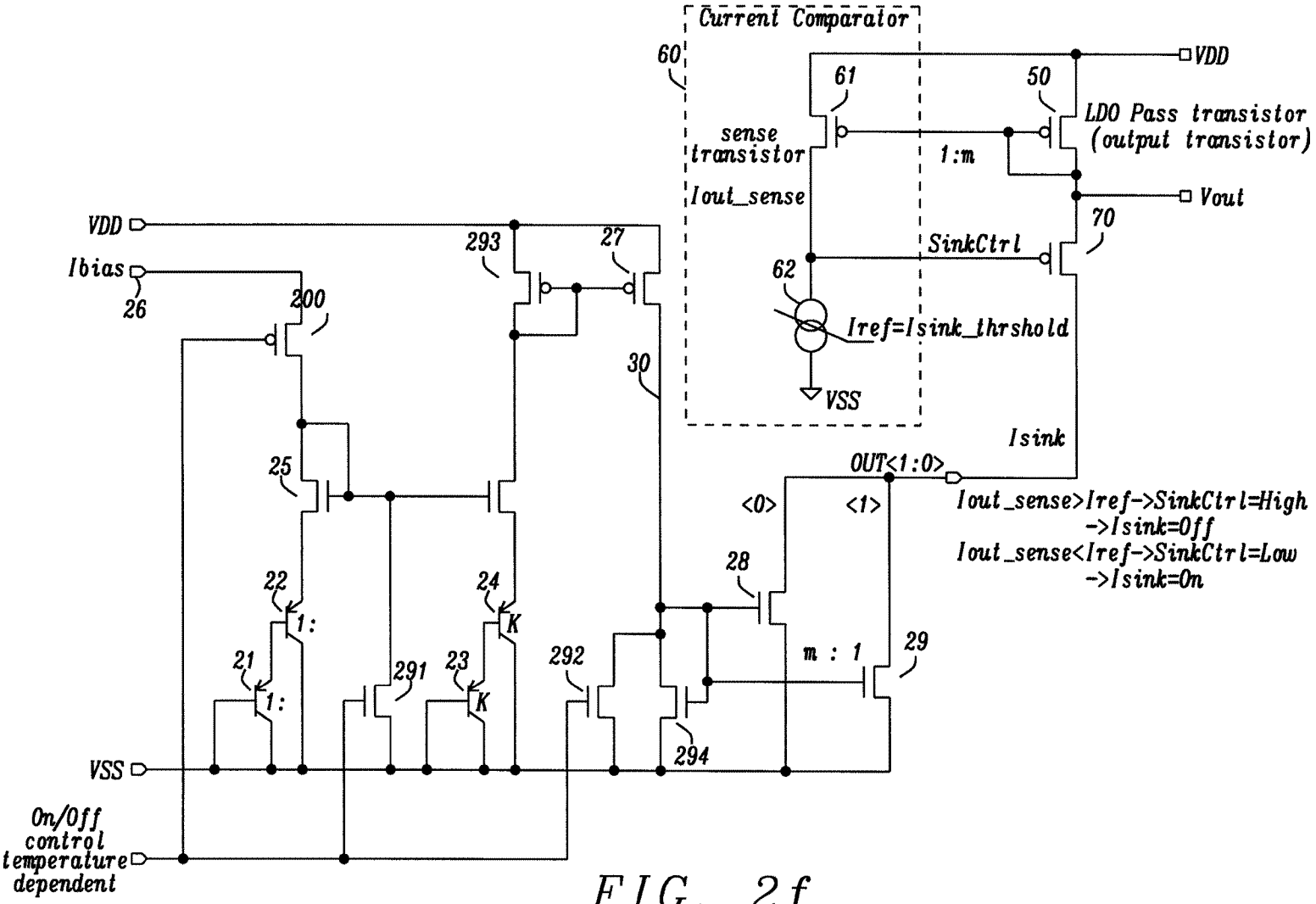
FIG. 2*f* shows a circuit diagram of another example of the non-PTAT, higher-order sink current generator according to embodiments of the disclosure with ON/OFF control dependent on temperature and output load current.

FIG. 2*f* illustrates another variation of the sink current generator 2 in FIG. 2*c* as an example for a circuit for controlling the sink current in dependence on the output current (output load). Here, a current comparator 60 is provided for comparing an output current flowing through a LDO pass transistor (output transistor) 50 of the LDO regulator 1 to a reference current Iref. The current comparator 60 may comprise a sense transistor 61 that forms a current mirror with the LDO pass transistor 50 and that may be a scaled replica of the LDO pass transistor 50 (e.g., a replica scaled by 1:m, with m larger than 1). The current comparator 60 may further comprise a controllable (e.g., programmable) current source 62 for generating the reference current Iref. The value of the reference current Iref may correspond to the given threshold value for the output current (e.g., to the value of the output current beyond which leakage current compensation is not required). Further, the value of the reference current Iref may be scaled to reduce the internal quiescent current of the circuit. The current comparator 60 may output a control signal SinkCtrl for controlling a switch device (e.g., transistor) 70 that is connected in series to the LDO pass transistor 50 and that provides the sink current to the output node of the LDO regulator 1. Thus, the sink current that is provided to the output node of the LDO regulator 1 is controlled (e.g., disabled, or gradually reduced) in accordance with the control signal SinkCtrl output by the current comparator 60. Control by the control signal SinkCtrl can result in an ON/OFF characteristic (comparator characteristic) for disabling the sink current generator 2 if the output current exceeds the given threshold value, or can realize gradual control (e.g., gradual decrease for increasing output current) of the sink current generated by the sink current generator 2. Whether the control by the control signal SinkCtrl results in an ON/OFF characteristic or realizes a gradual control of the sink current generated by the sink current generator 2 may depend on a gain of the current comparator 60 (e.g., a gain indicative of how steep the control signal SinkCtrl transitions from Low to High and vice versa depending on the output current), and/or on a transconductance (gm) of the transistor 70. For example, if the transistor 70 has a linear characteristic (e.g., for reasons of small W and very large L), an ON/OFF transition range of the transistor 70 will be very wide. In other words, ON/OFF control of the sink current as well as gradual control of the sink current can be realized by appropriate choice of the gain of the current comparator 60 and/or the transconductance of the transistor 70.

In general, the sink current generated by the sink current generator 2 may be controlled to be reduced if the sensed output current of the LDO regulator 1 is above a given threshold for the output current. The sink current generator 2 may be disabled (turned OFF) to reduce the sink current to zero. Alternatively, the sink current may be (gradually) reduced in accordance with a function that is negatively correlated with the output current for output current values above the given threshold value, i.e. that decreases for increasing output current. For example, the function may be a linear function with negative gradient. Further alternatively, the sink current may be (gradually) reduced in accordance with a function that is negatively correlated with the output current for output current values in a current range for the output current that includes the given threshold value (e.g., substantially at the center of the current range), i.e. that decreases for increasing output current. For example, the function may be a linear function with negative gradient. Yet further alternatively, the sink current may be controlled in accordance with a function of the output current that decreases for increasing output current, and may be altogether disabled once the sensed output current is above the predetermined threshold value for the output current. For example, the function may be a linear function with negative gradient. The above control of the sink current may be performed by a sink current generator disabling part. For example, the above control of the sink current may be performed by a circuit comprising the current comparator 60 and the transistor 70 illustrated in FIG. 2*f*.

Figure 3:
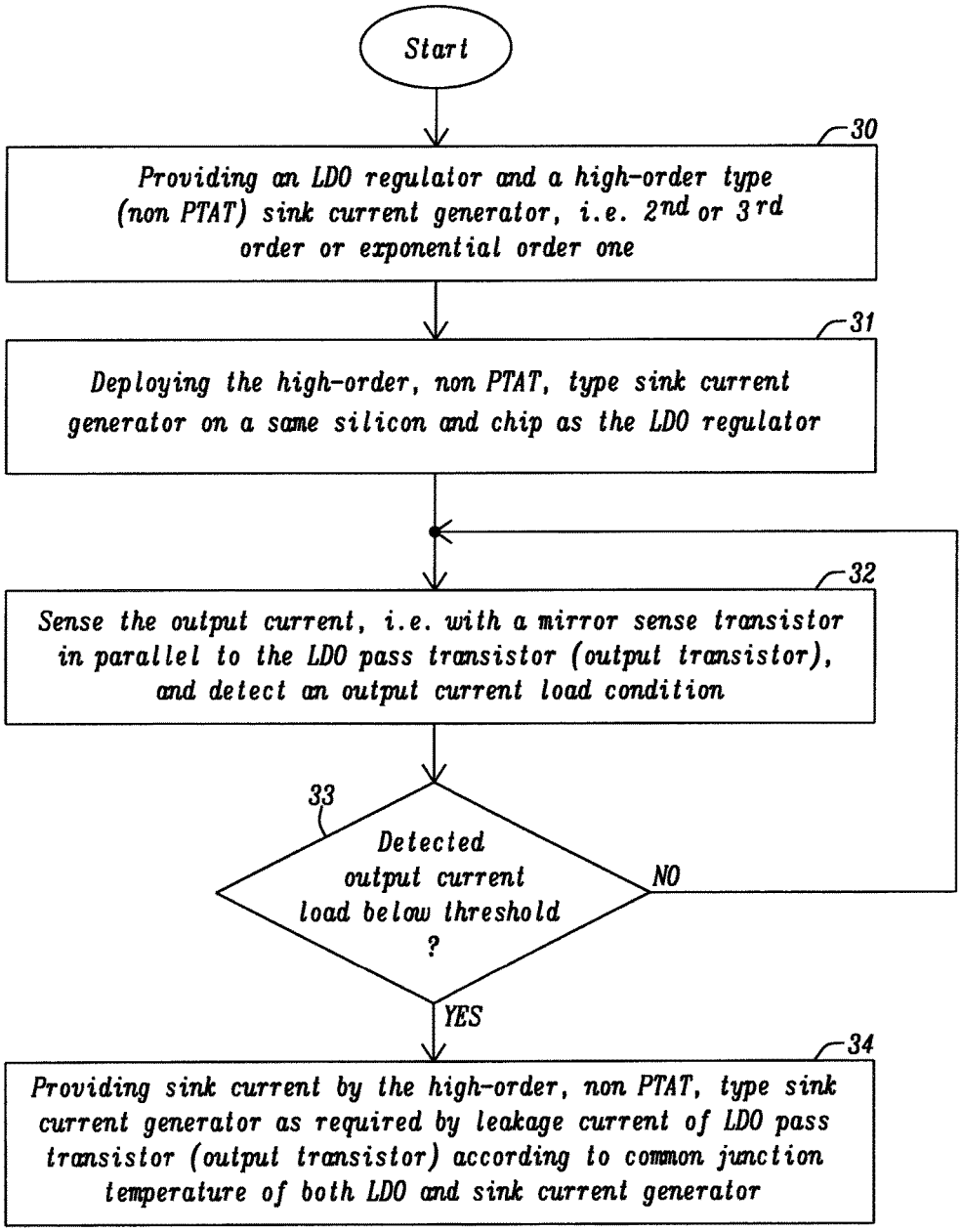
FIG. 3 illustrates a flowchart of an example of a method of leakage current compensation for a LDO regulator according to embodiments of the disclosure.

FIG. 3 illustrates an example of a flowchart of a method for leakage current compensation for a LDO regulator (e.g. a low power or ultra-low power LDO regulator) according to embodiments of the disclosure. Step 30 illustrates the provision of a LDO regulator and a high-order, non-PTAT, type sink current generator. Step 31 depicts deploying the high-order type sink current generator thermally coupled to the LDO regulator, e.g. on a same silicon and chip as the LDO regulator. Step 32 illustrates the measuring (sensing) of the output current of the LDO regulator, i.e. the current flowing through the output transistor of the LDO regulator. At step 33, it is determined whether or not the sensed output current is below a given threshold for the output current. If the sensed current is below the given threshold (YES at step 33), the method proceeds to step 34. Step 34 illustrates providing a sink current by the high-order non-PTAT type sink current generator as required for compensation of the leakage current of the LDO output transistor according to common junction temperature of both the LDO regulator and the sink current generator. On the other hand, if the sensed output current exceeds the given threshold (NO at step 33), the method returns to step 32. Thus, while the output current is above the given threshold, the output current is monitored, e.g. continuously, but the sink current generator does not output a sink current for leakage current compensation. As indicated above, the sink current generator may be turned OFF in this case, or may output a reduced sink current, e.g. depending on the sensed output current. The reduced sink current may not be sufficient for compensation of the leakage current of the LDO output transistor according to common junction temperature of both the LDO regulator and the sink current generator.

In summary, key items of the present disclosure are the following:

One key item of present disclosure relates to temperature-dependent sink current generation. The sink current generation maintains to have nearly no current consumption increase (e.g. only in the range of a few 10th of nA) at room temperature (RT) and starts generating sink current at higher temperature above e.g. 10 degrees Celsius (at which temperature leakage currents usually start having to be taken into account).

Another key item of the present disclosure relates to LDO circuitry that does not require overvoltage monitoring and clamping circuitry for purposes of leakage-caused output voltage increase protection. The present disclosure thus enables saving of corresponding current consumption of such circuitry.

Another key item of the present disclosure relates to circuitry for sink current generation which does not impact the regulation loop and/or does not change the LDO regulator topology.

Another key item of the present disclosure relates to sink current generation that is scalable with output transistor size to maintain different leakage current values (e.g. output transistor size dependent leakage current values).

Yet another key item of the present disclosure relates to output current dependent generation of the sink current, e.g. to output current dependent ON/OFF control of the sink current generator 2. According to this key item, the sink current may be reduced for output currents of the LDO regulator 1 above a given threshold for the output current. Alternatively, the sink current may be gradually reduced for increasing output current and may be altogether disabled once the output current is above the given threshold for the output current. Further alternatively, the output current may be gradually reduced in a current range for the output current that includes the given threshold value (e.g., substantially at the center of the current range). The sink current generated by the sink current generator 2 may be reduced in accordance with a function that is negatively correlated with the output current, and/or the sink current generator 2 may be disabled by ON/OFF control of the sink current generator 2.

It should be noted that the apparatus features described above correspond to respective method features that may however not be explicitly described, for reasons of conciseness. The disclosure of the present document is considered to extend also to such method features. In particular, the present disclosure is understood to relate to methods of operating the circuits described above.

It should further be noted that the description and drawings merely illustrate the principles of the proposed apparatus. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed method. Furthermore, all statements herein providing principles, aspects, and embodiments of the invention, as well as specific examples thereof, are intended to encompass equivalents thereof.

While the disclosure has been particularly shown and described with reference to the preferred embodiments thereof, it will be understood by those skilled in the art that various changes in form and details may be made without departing from the spirit and scope of the disclosure.

What is claimed is:

1. A method of leakage current compensation for a LDO regulator, the method comprising steps of:

(1) providing a LDO regulator and sink current generator, wherein the sink current generator is a non-PTAT type sink current generator;

(2) deploying the sink current generator on a same semiconductor substrate as the LDO regulator in such a manner that the sink current generator and the LDO regulator are thermally coupled;

(3) providing a sink current by the sink current generator as required to compensate a leakage current of an output device of the LDO regulator, wherein the sink current and the leakage current depend upon a common junction temperature of both the LDO regulator and the sink current generator;

(4) sensing an output current of the LDO regulator; and (5) if the output current exceeds a threshold value for the output current, reducing the sink current provided by the sink current generator.

2. The method of claim 1, further comprising a step of providing a bias current from the LDO regulator for the sink current generator, wherein the bias current is defined so as to maintain a defined current sink level.

3. The method of claim 2, wherein the bias current is mirrored down to a very small current level of e.g. about 50 nA.

4. The method of claim 1, further comprising providing a bias current from a bias current generator for the sink current generator, wherein the bias current is defined so as to maintain a defined current sink level.

5. The method of claim 1, wherein the sink current is scalable with a size of the output device of the LDO regulator, and wherein the leakage current of the output device depends also on the size of the output device.

6. A method of leakage current compensation for a LDO regulator, the method comprising steps of:

(1) providing a LDO regulator and sink current generator, wherein the sink current generator is a non-PTAT type sink current generator;

(2) deploying the sink current generator on a same semiconductor substrate as the LDO regulator in such a manner that the sink current generator and the LDO regulator are thermally coupled; and (3) providing a sink current by the sink current generator as required to compensate a leakage current of an output device of the LDO regulator, wherein the sink current and the leakage current depend upon a common junction temperature of both the LDO regulator and the sink current generator, wherein the sink current generator has an ON/OFF control dependent on the junction temperature, and wherein the sink current generator is switched on when the junction temperature has reached such a level that it causes a relevant leakage current of the output transistor and the sink current generator is switched off when the junction temperature is lower than this level, thus enabling zero power consumption.

7. The method of claim 1, wherein an arrangement of current mirrors allows for binary scaling of the sink current; and/or unused outputs can be shortened and do not contribute to the sink current value.

8. A circuit of a sink current generator used for leakage current compensation for a LDO regulator, wherein the sink current generator is a non-PTAT type sink current generator, and wherein the LDO regulator and the sink current generator are deployed on a same semiconductor substrate in such a manner that the sink current generator and the LDO regulator are thermally coupled, the circuit comprising:

a port for a bias current, wherein said port is connected to a first terminal of a switch which can activate/deactivate the sink current generator;

said switch, wherein the switch is controlled by a control voltage, which depends on a common junction temperature of the circuits of the LDO regulator and the sink current generator;

a port for said control voltage, wherein said control voltage switches off all transistors that might cause power consumption while the junction temperature is below a temperature threshold value;

a port for an output of the sink current generator, wherein said port is connected to an output port of the LDO regulator;

an arrangement of transistors forming a non-PTAT circuit, wherein the non-PTAT circuit generates a non-PTAT current, and wherein the non-PTAT current and the leakage current depend upon the junction temperature; and an arrangement of current mirrors to scale down the sink current in order to achieve a sink current suitable to compensate a leakage current of an output device of the LDO regulator.

9. The circuit of claim 8, further comprising:

an output current sense part, wherein the output current sense part senses an output current of the LDO regulator; and a sink current generator disabling part, wherein the sink current generator disabling part reduces the sink current provided by the sink current generator if the output current exceeds a threshold value for the output current.

10. The circuit of claim 8, wherein unused outputs of the sink current generator can be shorted to the VSS voltage level so that they do not contribute to the sink current value.

11. The circuit of claim 8, wherein an output transistor of the sink current generator can be either a NMOS transistor or a bipolar transistor.

12. The circuit of claim 8, wherein said bias current is derived from a current of the LDO regulator.

13. The circuit of claim 8, wherein said arrangement of transistors forming a non-PTAT circuit comprises bipolar transistors, e.g. stacked bipolar transistors or a single bipolar transistor, together with NMOS transistors in a current mirror configuration, wherein a current generated by the non-PTAT circuit rises as the junction temperature rises.

14. The circuit of claim 8, wherein said arrangement of transistors forming a non-PTAT circuit comprises a first bipolar transistor having a collector terminal and a base terminal connected to the VSS voltage level and an emitter terminal connected to a base terminal of a second bipolar transistor;

said second bipolar transistor has an emitter terminal connected to a source terminal of a first NMOS transistor and a collector terminal connected to the VSS voltage level;

said first NMOS transistor has a gate terminal and a drain terminal connected to a drain terminal of a PMOS transistor switch;

said PMOS transistor switch has a gate terminal connected to the port of said control voltage and a source terminal connected to the port of said bias current;

a third bipolar transistor has a collector terminal and a base terminal connected to the VSS voltage level and an emitter terminal connected to a base terminal of a fourth bipolar transistor; and said fourth bipolar transistor has an emitter terminal connected to a source terminal of a second NMOS transistor and a collector terminal connected to the VSS voltage level.

15. The circuit of claim 14, wherein sizes of said first and third bipolar transistors have a relationship of 1:K, wherein K is a number greater than 1; and/or sizes of said second and fourth bipolar transistors have a relationship of 1:K, wherein K is a number greater than 1.

16. The circuit of claim 14, wherein said first NMOS transistor and said second NMOS transistor form a current mirror.

17. The circuit of claim 8, wherein the arrangement of current mirrors allows binary scaling of the sink current.

18. The circuit of claim 8, wherein the arrangement of current mirrors comprises:

a third NMOS transistor, through which the non-PTAT current is flowing, having a source terminal connected to the VSS voltage level and a gate terminal connected to gate terminals of a fourth NMOS transistor and of a fifth NMOS transistor;

wherein said fourth NMOS transistor has a source terminal connected to the VSS voltage level and a drain terminal connected to the output port of the sink current generator; and said fifth NMOS transistor has a source connected to VSS voltage and a drain connected to the output port of the sink current generator.

19. The circuit of claim 18, wherein relations of sizes of said third, fourth, and fifth NMOS transistors allow binary scaling of the output current of the sink current generator; and/or said binary scaling is used to achieve different configurations of sizes of the output device and hence different leakage current.

20. The method of claim 6, further comprising a step of providing a bias current from the LDO regulator for the sink current generator, wherein the bias current is defined so as to maintain a defined current sink level.

21. The method of claim 6, wherein the bias current is mirrored down to a very small current level of e.g. about 50 nA.

22. The method of claim 6, further comprising providing a bias current from a bias current generator for the sink current generator, wherein the bias current is defined so as to maintain a defined current sink level.

23. The method of claim 6, wherein the sink current is scalable with a size of the output device of the LDO regulator, and wherein the leakage current of the output device depends also on the size of the output device.

24. The method of claim 6, wherein an arrangement of current mirrors allows for binary scaling of the sink current; and/or unused outputs can be shortened and do not contribute to the sink current value.

* * * * *